US006196598B1

(12) United States Patent
Yao

(10) Patent No.: US 6,196,598 B1
(45) Date of Patent: Mar. 6, 2001

(54) STRAIGHT HOLE DRILLING SYSTEM

(75) Inventor: James Jing Yao, Mississauga (CA)

(73) Assignee: Boart Longyear, Inc., Mississauga (CA)

( * ) Notice: Subject to any disclaimer, the term of this patent is extended or adjusted under 35 U.S.C. 154(b) by 0 days.

(21) Appl. No.: 09/003,156

(22) Filed: Jan. 6, 1998

(30) Foreign Application Priority Data

Jan. 6, 1997 (AU) ..... PO 4458

(51) Int. Cl.[7] ..... F16B 7/00; E21B 17/02

(52) U.S. Cl. ..... 285/333; 285/390; 403/307; 403/343

(58) Field of Search ..... 403/307, 343; 285/333, 340, 334

(56) References Cited

U.S. PATENT DOCUMENTS

| | | | | |
|---|---|---|---|---|
| Re. 27,284 | * | 2/1972 | Hjalsten et al. | 403/343 |
| 3,537,738 | * | 11/1970 | Fischer et al. | 403/343 |
| 3,645,570 | * | 2/1972 | Johansson et al. | 403/343 |
| 3,717,368 | * | 2/1973 | Czarnecki et al. | 403/343 |
| 3,822,952 | * | 7/1974 | Johansson et al. | 403/343 |
| 4,040,756 | | 8/1977 | Donegan . | |
| 4,295,751 | * | 10/1981 | Holmberg | 403/343 |
| 4,332,502 | | 6/1982 | Wormald et al. . | |
| 4,687,368 | * | 8/1987 | Eklof et al. | 403/343 |
| 4,760,887 | * | 8/1988 | Jansson et al. | 403/343 |
| 5,056,611 | | 10/1991 | Yousef et al. . | |
| 5,060,740 | | 10/1991 | Yousef et al. . | |
| 5,163,523 | | 11/1992 | Yousef et al. . | |
| 5,169,183 | | 12/1992 | Hallez . | |

FOREIGN PATENT DOCUMENTS

| | | |
|---|---|---|
| 922914 | 3/1973 | (CA) . |
| 1054816 | 5/1979 | (CA) . |
| 1113920 | 12/1981 | (CA) . |
| 1161830 | 2/1984 | (CA) . |
| 1272386 | 8/1990 | (CA) . |

OTHER PUBLICATIONS

A.I. Yakushev, "Effect of Manufacturing Technology and Basic Thread Parameters on the Strength of Threaded Connexions", 1964, pp. 36–37, 72–73, and 94–95.

* cited by examiner

*Primary Examiner*—Eric K. Nicholson
(74) *Attorney, Agent, or Firm*—Covington & Burling

(57) ABSTRACT

A drill rod for a drill string has a thread at each end and is connected to an adjacent rod by a sleeve. The threads on the sleeve and rod are configured to reduce stress concentrations and provide sacrificial wear on the sleeve. The thread has a single start with a part circular root and the wear volume on the sleeve is less than that on the rod. The outer diameter of the rod is at least twice that of the inner bore.

3 Claims, 4 Drawing Sheets

STRAIGHT HOLE DRILLING SYSTEM

The present invention relates to drill strings.

Drill strings are used to transmit rotary and percussive forces from a surface drilling machine to a drill bit. The holes bored may be relatively deep, typically 50 feet, and accordingly, the string is made from a series of drill rods that are connected by couplings. Typically, the ends of each rod are threaded and the coupling is an internally threaded sleeve which receives the ends of adjacent rods.

When the strings are used to bore blast holes, for example, it is important that the holes are drilled as straight as possible to preserve the required pattern of the blast holes. Deviation of the hole during drilling will produce a different pattern at the bottom of the holes to that at the surface and the results of the blast will therefore be inconsistent. Deviation of the drill string is caused primarily by bending induced by the vertical loads caused by the feed of the string and the percussive forces on the string. In some cases, the deviation can be extreme, resulting in a deviation of several feet over a 50-foot hole. The effect of this is to increase the production costs as the spoil or "muck pile" created from blasting is of a non-uniform size which may require additional secondary breaking to accommodate the size of hauling equipment. It is a goal of the drilling industry to maintain the deviation to within 1.0% but this has not been achieved on a consistent basis.

One approach to reducing the deviation is to utilize tube drilling. In tube drilling, a thin walled metal tube that has an outside diameter close to the drilled hole size is utilized in an attempt to provide the requisite bending stiffness. However, the thin walled tubing limits the form of thread that can be used to connect the tubes with the result that an unsatisfactory rod life is obtained.

An alternative approach is to avoid percussive loads on the threads by placing the percussive hammer down inside the hole (DTH systems) and not transmitting the percussive shock wave through the connecting string. However, this approach tends to be more expensive.

It is therefore an object of the present invention to obviate or mitigate the above disadvantages.

According to one aspect of the invention. a drill string includes a plurality of drill rods for connection in series and each having at least one thread formed at one end thereof for connection to an adjacent rod. Each drill rod includes a cylindrical body having an outer surface and an internal bore extending between the ends of the rod. The diameter of the rod is greater than or equal to 65 mm and the ratio of the diameter of the body to that of the bore is at least 2:1 and preferably equal to or greater than 3:1.

By increasing the outer diameter of the rod, the bending stiffness of the rod is increased but by maintaining the ratio of the bore within the prescribed limits, an appropriate form of thread can be provided.

An increase in rod diameter generally has been considered to be detrimental to the life of the thread used to interconnect the rods as the larger root area associated with the increased diameter results in an increased region of high stress concentration and thus reduces the fatigue life of the rod. The longitudinal loads are significantly increased if the string is "rattled" during withdrawal to assist in loosening the couplings. Rattling imposes rapidly reversing vertical loads on the string and the stresses induced may cause failure of the threads, particularly the initial thread which is more heavily loaded than the other threads.

Previous attempts have been made to reduce the stress concentrations by adopting specific profiles for the threads.

In U.S. Pat. Nos. 5,056,611; 5,060,740; and 5,163,523, the thread is formed with a part elliptical root which, according to these patents, provides a larger effective root diameter and therefore reduced stress concentration. However, in each case, the thread profile is asymmetric and to maintain an adequate wear volume, the ellipses used to define the roots of the male and female threads are of different sizes or configurations. This unduly complicates the production of the thread. Moreover, the fatigue life is still determined by the highest stress concentration in the threaded structure and so a high stress concentration at one root will effectively limit the life of the joint.

There is therefore a need to provide a threaded joint in which the above disadvantages are obviated or mitigated.

According to another aspect of the present invention, there is provided a threaded coupling for a drill string having a pair of cooperating male and female threaded members. Each of the members has a respective thread with a pair of opposed flanks extending between a crown and a root region. The root region is radially spaced from the crown and has a part circular generatrix with the flanks tangential there to.

Preferably, the female threaded member has a tapered outer surface which reduces in diameter towards the distal end of the female member and extends over at least one pitch of the thread.

Preferably, the tapered portion has a half angle of between 3° and 10° and, more preferably, between 4° and 6°.

One factor associated with the life of the thread is the wear volume which is the volume of material between adjacent flanks of the thread that can be sacrificed before the flanks intersect. This volume can be increased by utilizing a single start thread as the spacing between adjacent flanks is then increased. However, wear will inevitably occur and can lead to premature replacement of the rod.

According to a further aspect of the invention, a coupling between adjacent components of the string includes a male threaded member and a female threaded member for interengagement with one another. Each of the threads have oppositely directed convergent flanks longitudinally spaced along the member. The threads contact over at least a portion of the flanks to define respective wear volumes between the oppositely directed flanks. The wear volume defined on one of the members is greater than the wear volume on the other member.

Preferably, the female threaded member is a sleeve and the wear volume on the female threaded member is less than that on the male threaded member so that replacement of the sleeve will be required prior to replacement of the rod.

Preferably, the thread is formed such that the longitudinal dimension of the crest of the female thread is less than the longitudinal dimension of the crest of the male thread to provide an increased wear volume for the male thread. It is preferred that the female thread has a wear volume of between 80% and 95% of the male member, more preferably 89% to 95% and typically, 92%.

According to a still further aspect of the invention, there is provided a threaded coupling for a drill string having a pair of co-operating male and female threaded members. Each of said threaded members has a single start helical thread with a helix angle of between 7° and 10° with a pair of opposed flanks extending between a crest and a root region. The root region is defined by a part circular generatrix with the flanks tangential thereto. Each flank is delimited by a crest extending generally parallel to the longitudinal axis of the thread. The depth of each thread measured radially is greater than 5 mm and flanks of the male thread and female thread overlap radially greater than 3.7 mm.

Preferably, the axial dimension of the crest on the female and male threads differs and as a further preference, the axial dimension of the female crest is less than that of the male crest.

An embodiment of the invention will now be described by way of example only with reference to the accompanying drawings, in which.

Figure 1:
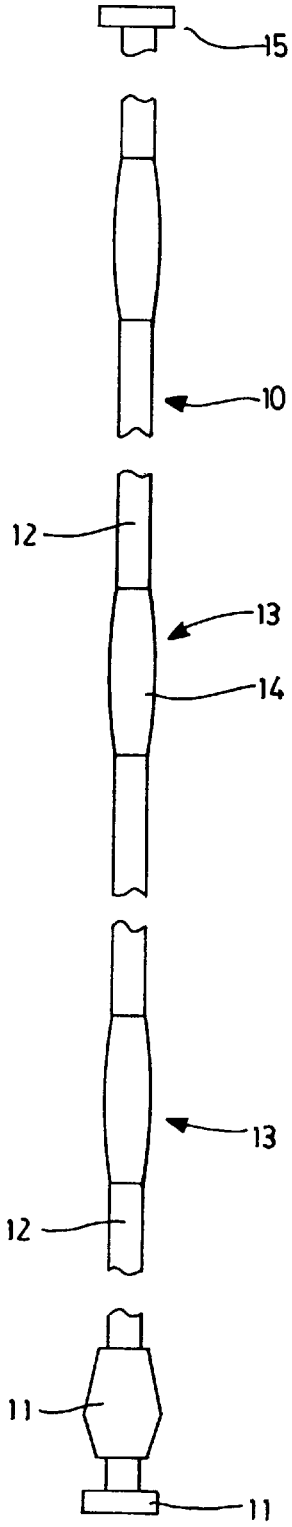
FIG. 1 is a front elevation of a drill string.

Referring therefore to FIG. 1, a drill string 10 includes a number of drill rods 12 connected end to end at joints 13 by sleeves 14. The rods and sleeves are formed from a suitable metal, typically a steel such as AHT-28 or that known as "Javelin", as is well known in the art. The string 10 is connected at one end to a drill machine (not shown) by means of a striker bar 15 and at the opposite end to a drill bit 11. The string 10 transmits rotation and percussive loads from the machine to the bit 11 to drill a hole.

Figure 2:
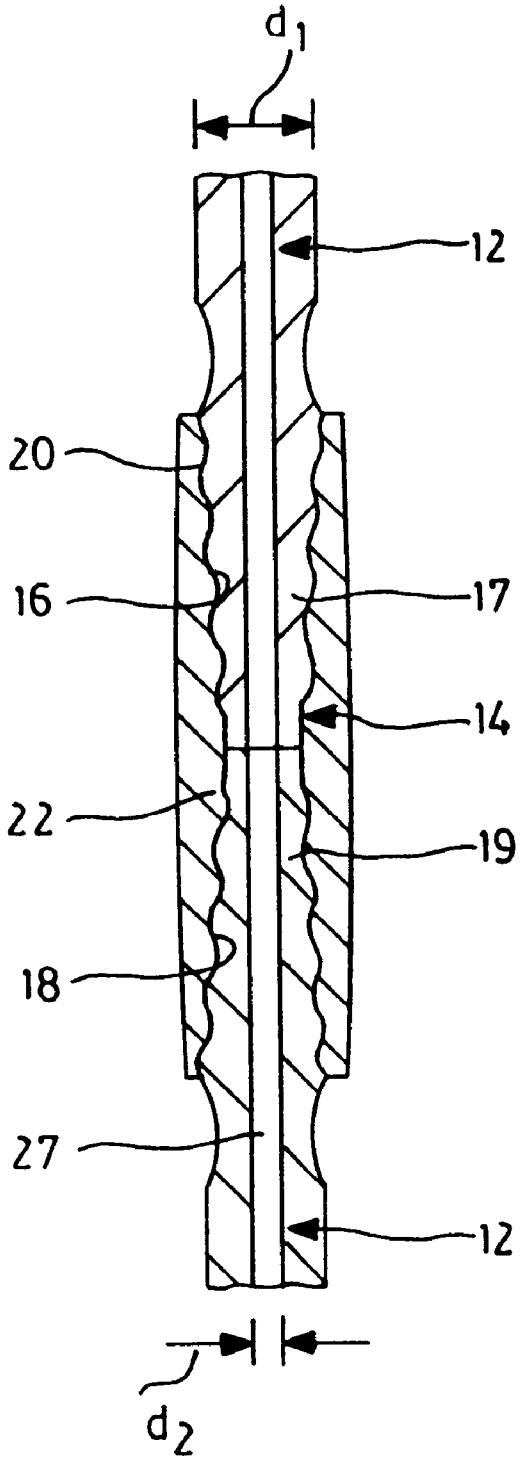
FIG. 2 is a sectional view of a joint in the string of FIG. 1.
Figure 6:
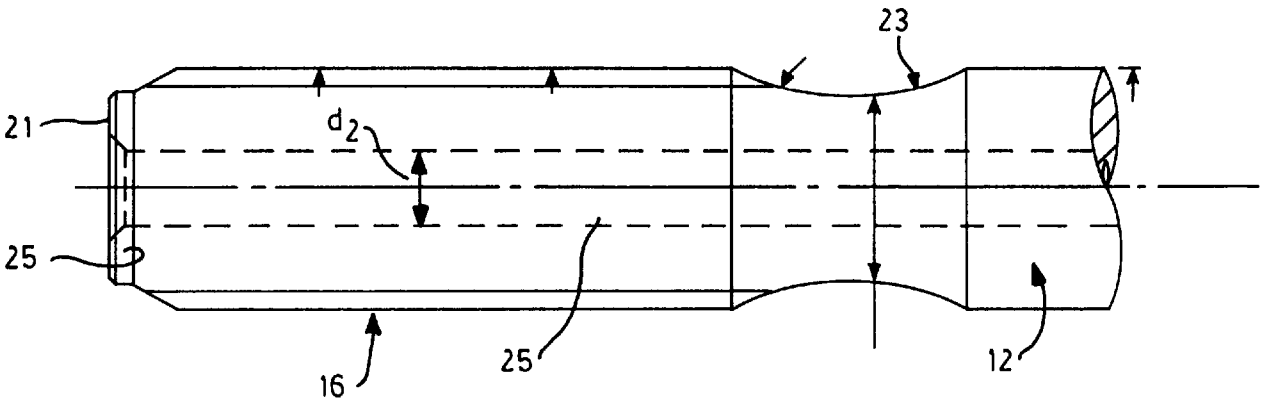
FIG. 6 is a sectional view of one end of a rod shown in FIG. 2.

As can be seen more clearly in FIGS. 2 and 6, each of the drill rods 12 is cylindrical having an outer diameter d, and a male thread 16, 18 formed at opposite ends 17, 19 for connection to the sleeve 14. Each of the ends 17, 19 is identical and, accordingly, only one will be described in detail with reference to FIG. 6. The thread 16 is formed on the outer surface and extends from a planar end face 21 to a waist 23. The end face 21 projects axially beyond the thread 16 to provide a cylindrical button 25 of diameter less than the thread 16. The waist 23 has a diameter less than the thread and is uniformly radiused with tangential flanks extending to the rod surface and the thread 16. A bore 27 extends internally through the rod 12 and has an inner diameter $d_2$.

Figure 5:
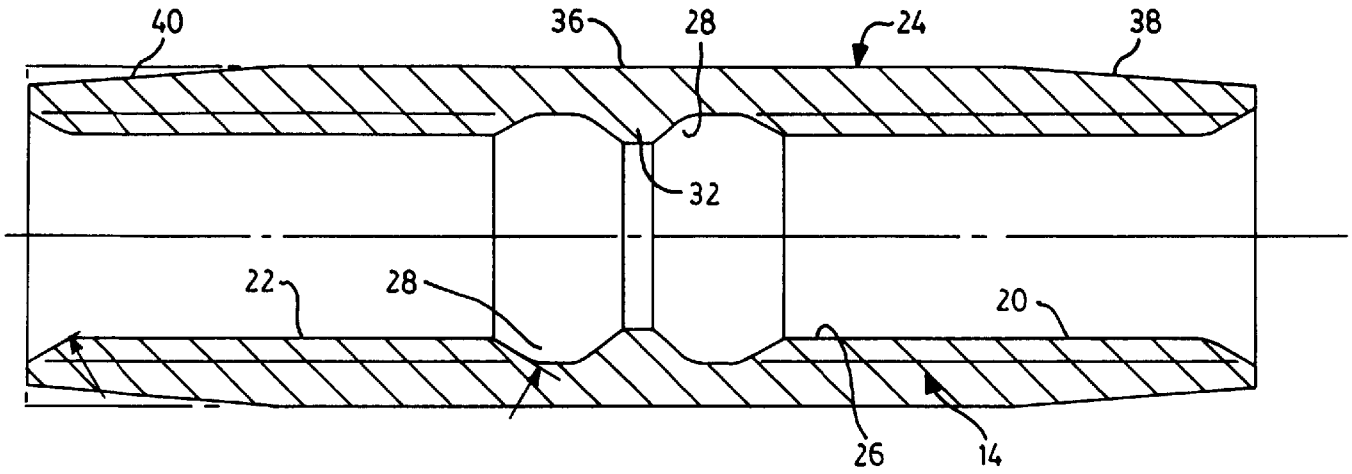
FIG. 5 is a sectional view of a sleeve shown in FIG. 2.

Referring to FIG. 5, the sleeve 14 has a complementary pair of female threads 20, 22 to receive the threaded ends 17, 19 of adjacent rods 12. The female threads 20, 22 are formed on the inner wall 26 of the tubular body 24 of the sleeve 14. The threads 20, 22 terminate at spaced annular recesses 28, 30 that are separated by a land 32 that projects inwardly into the body 24. The outer surface 34 of the body 24 has a central cylindrical section 36 and, in the preferred embodiment, tapered sections 38, 40 at opposite ends that reduce in diameter from the central section 36 to the distal ends of the sleeve 14.

Figure 3:
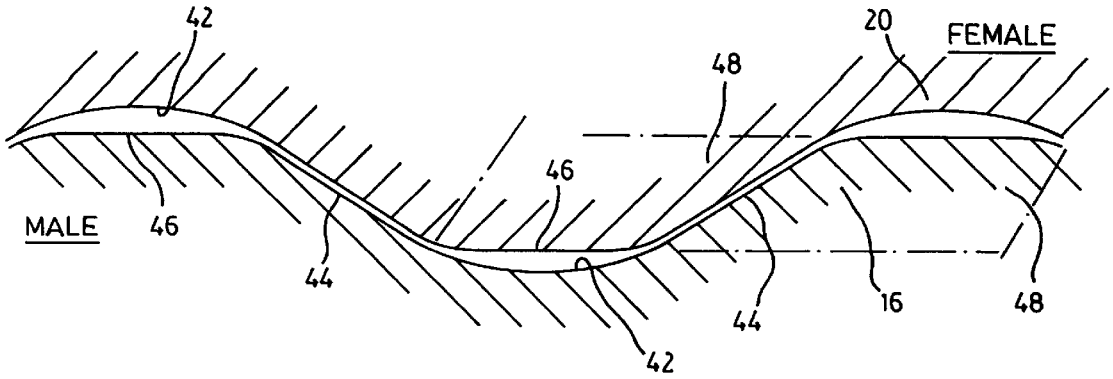
FIG. 3 is an enlarged view of the threads in the joint of FIG. 2.
Figure 4:
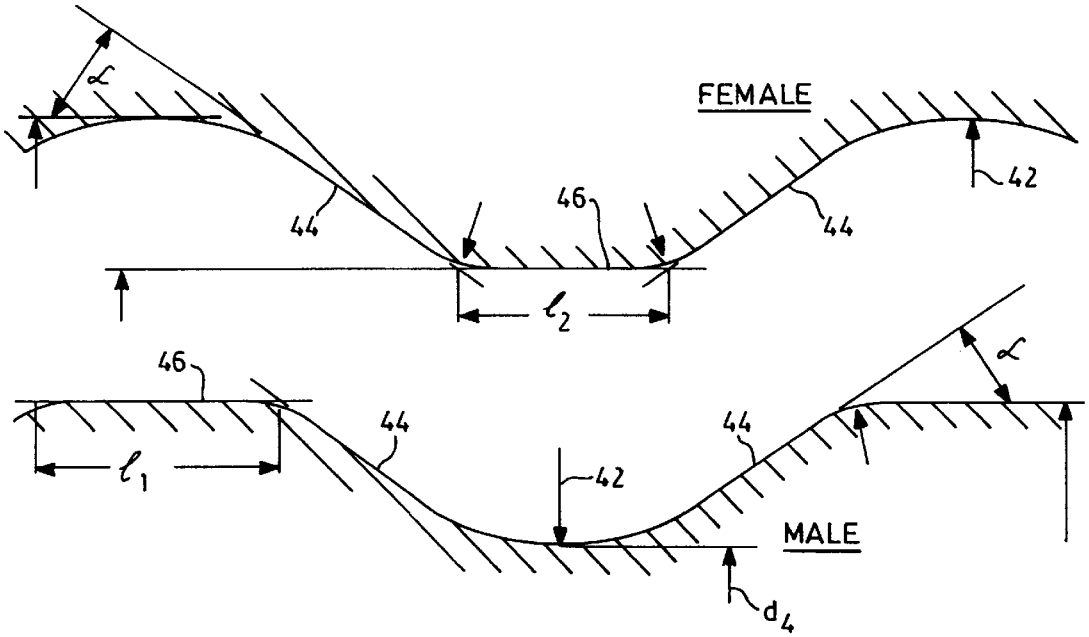
FIG. 4 is a view similar to FIG. 3 with the components separated.

The thread form can best be seen in FIGS. 3 and 4 and has a similar though not identical form for the male and female threads so that like reference numerals will be used to denote similar components. The thread is a single start thread and each of the threads 16, 18, 20, 22 (FIG. 2) has a root 42 defined by a part circular generatrix with linear flanks 44 extending tangentially from the root 42 at an angle $\alpha$ to the longitudinal axis of the rod 12. The linear flanks 44 are truncated by a flat crest 46 that extends between adjacent flanks 44 and is smoothly radiused typically in the order of 6 mm, to merge with the flanks 44. It will be noted from FIG. 3 that when assembled, the crest 46 is spaced from the root 42 so that only the linear flanks 44 of the male and female threads are in contact to transfer the loads. Each of the threads has a wear volume 48, indicated by chain dot lines, defined between adjacent flanks 44 as the minimum longitudinal spacing between the portions of the flank in contact with the other thread and the opposition directed flank and which defines the volume of material that may be removed before the flanks 44 intersect.

In the specific example shown, the outside diameter d, of the rod 12 is 68 mm and more generally should be greater than 65 mm to reduce the deflection resulting from the vertical loads imposed. The bore 27 has an internal diameter of 22 mm to provide a ratio of outside to inside diameter of greater than 3:1. More generally, the ratio should be greater than 2:1 to provide the requisite stiffness and allow formation of the thread 16.

The tapered sections 38, 40 of the sleeves 14 each extend over several pitches of the thread 16 and, preferably, extend at least one pitch and typically over 2.5 to 3.5 pitches. The angle of the taper, i.e. half the cone angle, is selected to distribute the loads among the threads. The taper 38, 40 matches the longitudinal elasticity of the sleeve 14 more closely to that of the threads 16 so that the maximum stress on the thread profiles is mitigated. In one example, a taper of 4.2° has been found beneficial and more generally tapers in the range of 3° to 10° may be utilized, preferably in the range of 4° to 6°. The taper angles referred to above are the angle of the surface to the longitudinal axis, i.e. are half the included cone angle. Although a tapered section on the sleeve is preferred for optimum stress mitigation, the tapers may be omitted and satisfactory operation of the coupling obtained.

The thread selected may be of any suitable form, but a flank angle of 35° with a pitch of 1.179 inches (approximately 30 mm) and a helix angle of between 7° and 10°, preferably 8.9°, has been found satisfactory with a nominal major diameter of 68 mm.

The major diameter of the male thread was 2.660 inches (approximately 68 mm) and a circular root profile of appropriate radius was utilized. A thread depth from crest to root of greater than 0.2 inches (5 mm) has been found satisfactory.

It will be noted from FIGS. 3 and 4 that the longitudinal dimension of the crests 46 indicated at $l_1$ and $l_2$ differ between the male and female threads. The crest 46 of the female threads 20, 22 ($l_2$) is shorter than the male thread by up to 20% of the crest on the male thread. The crest 46 of the female threads 20, 22 may be between 80% and 100% of the crest 46 of male thread 16 ($l_1$) typically between 89% and 95%, preferably 92%. The difference in lengths of the crests 46 proportions the available wear volume between the sleeve 14 and rod 12 so that there is less wear volume on the sleeve 14. In this manner, the sleeve will require replacing prior to the rod, thereby preserving the life of the rod 12. A thread depth of greater than 5 mm (approximately 0.2 inches) is preferred and preferably greater than 5.3 mm (i.e. 0.21 inches). To provide the requisite wear volume, the male and female threads should preferably overlap greater than 3.8 mm (i.e. 0.15 inches) and more preferably, greater than 3.8 mm (i.e. 0.15 inches) and, more preferably, greater than 0.43 mm (i.e. 0.17 inches).

To connect a pair of rods 12, the sleeve 14 is threaded onto the thread 16 at end 17 until the end of the thread abuts the side of the land 32. In this position, the button 25 overlaps the land 32. The end 19 of the next rod 12 is threaded in to the sleeve 14 until it abuts the side of land 32. In that position, the end faces 21 are in contact. As the torque is applied to the string 10, the joint 13 tightens and imposes a longitudinal stress upon the threads.

Upon mating of the male and female threads, the radiused root 42 is spaced from the crest 46 of the engaging thread and so out of the contact area between the flanks 44. The root 42 provides an area of maximum stress concentration which is spaced from the contact area and accordingly is considered beneficial. The tapering of the sleeve 14 also contributes to the reduction in maximum stress by matching the longitudinal elasticity of the sleeve 14 to the stress distribution in the threads.

The string 10 as exemplified above has been found to provide significant advantages over those utilizing thread forms presently widely available such as that known as HM51. In particular, the wear volume 48 is increased 2.9 and 3.5 times respectively and the maximum tensile stress at the critical location is 10% less than that of the joint provided by available thread and sleeve combinations for a given impact load. Finite element analysis indicates that even with an impact force that is 50% greater than that experienced in the HM51 joint, the maximum tensile stress at the critical location is still 22% less than that previously encountered. The reduction in stress is, of course, indicative of an increased life of the joint 10.

It will be seen, therefore, that the provision of the tapered sleeve to match the longitudinal elasticity to the stress distribution in the threads does provide a reduction in the stress levels at the critical locations and that the spacing of the crown and radiused root ensure that the maximum stress concentration is remote from the contact area. Accordingly, a larger diameter rod can be provided to increase the stiffness and enhance the straight line drilling performance of the rod. The differential wear volume resulting from the different lengths of crown provides preferential wear on one of the components so that the lip of the more expensive component may be extended.

It will be appreciated that whilst the joint 13 has been illustrated with a sleeve as the female member of the female thread could be formed integrally with one end of the rod. However, the provision of a separate sleeve enables it to be replaced without sacrificing the entire rod at the end of its useful life.

The embodiments of the invention in which an exclusive property or privilege is claimed are defined as follows:

1. A component of a drilling system having a female threaded connector for receiving a complementary male thread of an adjacent component, said female threaded connector having a single start thread with a part circular generatrix and linear flanks tangential to the root, and smoothly merging with flat crests, said thread having a helix angle of between 7° and 10° and a nominal major diameter greater than 2.56 inches.

2. A component according to claim 1 wherein said thread depth is greater than 0.2 inches.

3. A component according to claims 1 or 2 wherein said thread has a flank angle of 35°.

* * * * *